US005327767A

United States Patent [19]

Narishima

[11] Patent Number: 5,327,767

[45] Date of Patent: Jul. 12, 1994

[54] PRESS WORKING APPARATUS

[75] Inventor: Shigeki Narishima, Yokosuka, Japan

[73] Assignee: Ishikawajima-Harima Heavy Industries Co., Ltd., Tokyo, Japan

[21] Appl. No.: 46,168

[22] Filed: Apr. 15, 1993

[30] Foreign Application Priority Data

Apr. 22, 1992 [JP] Japan ..... 4-103257

[51] Int. Cl.[5] ..... B21B 15/00; B21D 13/00; B21D 37/08

[52] U.S. Cl. ..... 72/338; 72/340; 72/184; 72/186; 72/206; 72/342.1; 72/407; 72/412; 72/416

[58] Field of Search ..... 72/412, 416, 407, 206, 72/342.1, 168, 166, 184, 186, 325, 338, 340

[56] References Cited

U.S. PATENT DOCUMENTS

| | | | |
|---|---|---|---|
| 2,670,314 | 2/1954 | Ungar . | |
| 3,333,452 | 8/1967 | Sendzimir | 72/184 |
| 3,521,472 | 7/1970 | Bringewald | 72/184 |
| 4,598,569 | 7/1986 | Carroll et al. | 73/325 |

FOREIGN PATENT DOCUMENTS

| | | | |
|---|---|---|---|
| 6870274 | 5/1973 | Australia . | |
| 3240155 | 5/1983 | Fed. Rep. of Germany . | |
| 177802 | 11/1982 | Japan | 72/206 |
| 174902 | 7/1991 | Japan | 72/206 |
| 27830 | 4/1917 | Netherlands | 72/407 |

*Primary Examiner*—Daniel C. Crane
*Attorney, Agent, or Firm*—Finnegan, Henderson, Farabow, Garrett & Dunner

[57] ABSTRACT

A press working apparatus has a press machine provided with a pair of press dies. The press machine presses a preheated metal slab being transferred in a feeding direction with the press dies mutually opposed to press the metal slab in a direction perpendicular to the thickness of the metal slab. Each press die has a pressing surface facing a respective surface of the metal slab. The pressing surface of each press die has a predetermined length extending in the feeding direction of the metal slab. At least one of the pressing surfaces has a cross section perpendicular to the feeding direction of the metal slab. The shape of the cross section gradually changes along the feeding direction of the metal slab so as to have a predetermined sectional shape for forming the metal slab into a required sectional shape. At least one surface of the metal slab is gradually formed into a predetermined sectional shape as the metal slab is passing through the press machine.

13 Claims, 13 Drawing Sheets

PRESS WORKING APPARATUS

BACKGROUND OF THE INVENTION

The present invention relates to the field of press working, and in particular, relates to a press working apparatus which can form a metal slab into a ribbed board or a mesh grid such as a reinforcing net.

In the manufacturing of a ribbed steel board consisting of a steel board and reinforcing ribs provided perpendicular thereto, it has thus far been conventional to provide a steel board and ribs, and to weld the ribs to a surface of the steel board.

Furthermore, when manufacturing a mesh grid such as a reinforcing net, it has thus far been conventional to arrange a plurality of steel bars (reinforcing bars) in a net structure, and then to tie the steel bars with tying members such as wires, or to weld each intersection of the assembled steel bars.

However, the above conventional method for manufacturing ribbed steel boards or mesh grids presents problems such as those described below. That is, in order to manufacture a ribbed steel board by the above method, welding is required to form the steel board, and in order to manufacture a reinforcing net by the above method, it is necessary to tie or weld the steel bars, which is troublesome, after arranging the steel bars in a mesh structure. Additionally, since the welding should be performed at many points for a grid or over a long joint in a ribbed board, the work efficiency of the welding is lowered, and quality control of the welding is difficult.

SUMMARY OF THE INVENTION

The present invention was developed in view of the above situation; it is an object thereof to provide a press working apparatus which can manufacture ribbed steel boards or mesh grids without complicated procedures such as welding or tying.

In order to accomplish this object, the present invention provides a press working apparatus, the press working apparatus comprising a press machine provided with a pair of press dies, said press machine for pressing a preheated metal slab being transferred in a feeding direction, said press dies being disposed so as to be mutually opposing and being disposed so as to press said metal slab in a direction perpendicular to the thickness of said metal slab, each said press die being provided with a pressing surface facing a respective surface of said metal slab, said pressing surface of each said press die having a predetermined length extending in said feeding direction of said metal slab, at least on of said pressing surface having a cross section perpendicular to said feeding direction of said metal slab, the shape of said cross section gradually changing along the feeding direction of said metal slab so as to have a predetermined sectional shape, for forming said metal slab into a required sectional shape, at the leading end of the pressing surfaces in the feeding direction.

In the press working apparatus according to the present invention, at least one surface of the metal slab is gradually formed into a predetermined sectional shape as the metal slab passes through the press machine.

In the case of forming one side of the metal slab so as to produce a ribbed board by the press machine, the sectional shape of only one of the pressing surfaces may be altered. That is, at least one groove extending toward the feeding direction, into which some portions of the metal material consisting of the metal slab can move, is formed on one of the pressing surface. At a trailing end of the press die in the feeding direction, each of the grooves is broad and shallow so that the pressed metal of the metal slab can move easily into the grooves. As the grooves extend toward a leading end of the press die, the width thereof increases and the depth thereof decreases. The width and the depth of each of the grooves ultimately conform to the required cross sectional shape, at the leading end of the pressing surface, so as to form the metal slab into the required sectional shape. Based on this structure, the metal material moving through the groove can be formed into a predetermined rib shape as the metal slab passes through the press machine.

In the case in which both sides of the metal slab are formed by the press machine, the sectional shapes of both of the pressing surfaces may be altered. That is, when a metal slab is formed into a mesh grid, the sectional shapes of both of the pressing surfaces are defined so that holes may be formed in the first stage of the press process, and the formed holes can then be gradually enlarged as the metal slab is transferred.

DESCRIPTION OF THE PREFERRED EMBODIMENTS

With reference to FIGS. 1-15, a press working apparatus according to the first embodiment of the present invention will be explained below.

First, the press machine, which is adopted in the press working apparatus of the first embodiment of the present invention and which composes a main part of the press working apparatus, will be explained.

Figure 1:
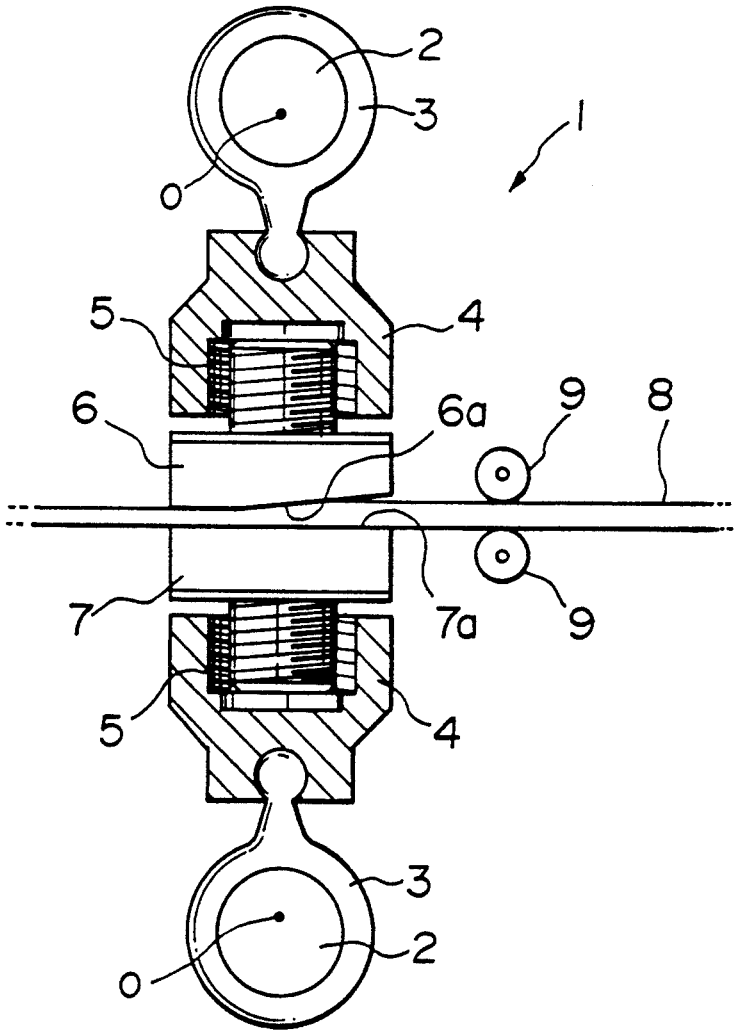
FIG. 1 is a partial schematic longitudinal sectional view of the press machine which is adopted in the press working apparatus of the first embodiment of the present invention.

As shown in FIG. 1, a press machine 1 of the first embodiment of the present invention is provided with a pair of connecting rods 3. Each of the connecting rods 3 is driven respectively by means of an eccentric shaft 2 which is rotated about the center of rotation 0. Each end of the connecting rods 3 is provided with a slider 4. At the side opposite to the side of each slider 4, where each of the connecting rods 3 is provided, a screw nut 5 is provided. An upper press die 6 and a lower press die 7, which are paired with each other, are engaged with the screw nuts 5, respectively. Each of the press dies 6 and 7 has pressing surfaces 6*a* and 7*a* respectively, and is positioned in such a way that the pressing surfaces 6*a* and 7*a* are facing each other at a distance. Based on this structure, a preheated metal slab 8, transferred passing through the press machine 1, would be pressed by means of the press dies 6 and 7 when the eccentric shafts 2 are driven. In the front part of the press machine 1, a pair of pinch rollers 9 are arranged so as to guide the transfer of the metal slab 8.

Figure 3:
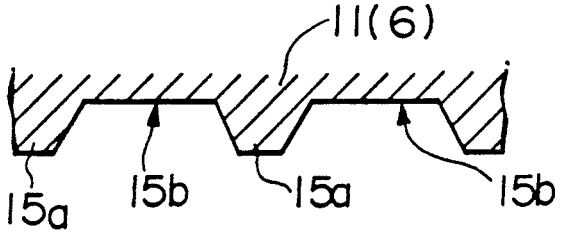
FIG. 3 is a partial sectional view taken along the line III—III in FIG. 2, showing one of the dies of the press machine which is adopted in the press working apparatus of the first embodiment of the present invention.
Figure 4:
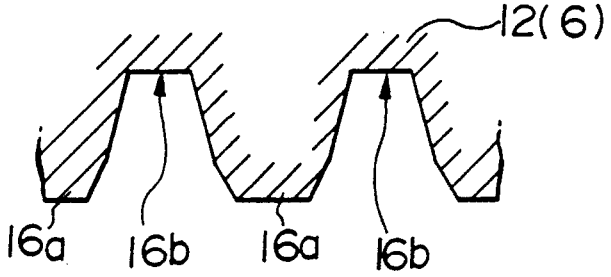
FIG. 4 is a partial sectional view taken along the line IV—IV in FIG. 2 showing one of the dies of the press machine.
Figure 5:
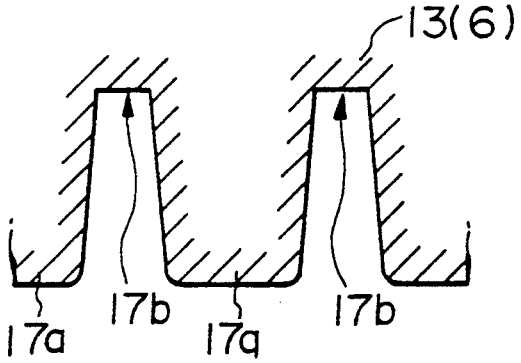
FIG. 5 is a part sectional view taken along the line V-V in FIG. 2 showing one of the dies of the press machine.

The upper die 6 is divided in three parts along the slab feeding direction: a front die portion 11, a middle die portion 12, and a rear die portion 13. On the pressing surface 6*a* of the first die portion 11, as shown in FIG. 3, a plurality (four, in this embodiment) of first ridges 15*a* extending in the feeding direction, each of the cross sectional shapes of which being nearly trapezoidal, are formed parallel to each other. The protruding height of each of the first ridges 15*a* is small, and the width of each of the first ridges 15*a* is narrower than that of each first groove 15*b* formed adjacently between two of the first ridges 15*a*. On the pressing surface 6*a* of the middle die portion 12, as shown in FIG. 4, a plurality of second ridges 16*a* extending in the feeding direction are formed parallel to one another. The cross-sectional shapes of each of the second ridges 16*a* are also nearly trapezoidal, but both the width and the protruding height are greater than those of the first ridge 15*a*. Accordingly, the width and the depth of each second groove 16*b*, which is formed adjacently between two of the second ridges 16*a*, are narrower and deeper than those of the first groove 15*b*. The numbers and the positions of the second ridges 16*a* are the same as those of the first ridges 15*a*. On the pressing surface 6*a* of the rear die portion 13, as shown in FIG. 5, a plurality of third ridges 17*a* extending in the feeding direction are formed parallel to one another. The cross-sectional shape of each of the third ridges 17*a* is also nearly trapezoidal, but both the width and the protruding height are greater than those of the second ridge 16*a*. Accordingly, the width and the depth of each of the third grooves 17*b* which is formed between two of the third ridges 17*a*, are further narrower and deeper than those of the second groove 16*b*. The numbers and the positions of the third ridges 17*a* are the same as those of the second ridges 16*a*. The cross-sectional shape of each of the third grooves 17*b* is nearly the same as that of a rib 19 of a ribbed board 18, which will both be described hereinafter. As mentioned above, the cross-sectional shape of the upper die 6 is changed from the trailing end to the leading end of the upper die 6 so as to approximately meet the cross-sectional shape of the final article to be obtained.

Figure 2:
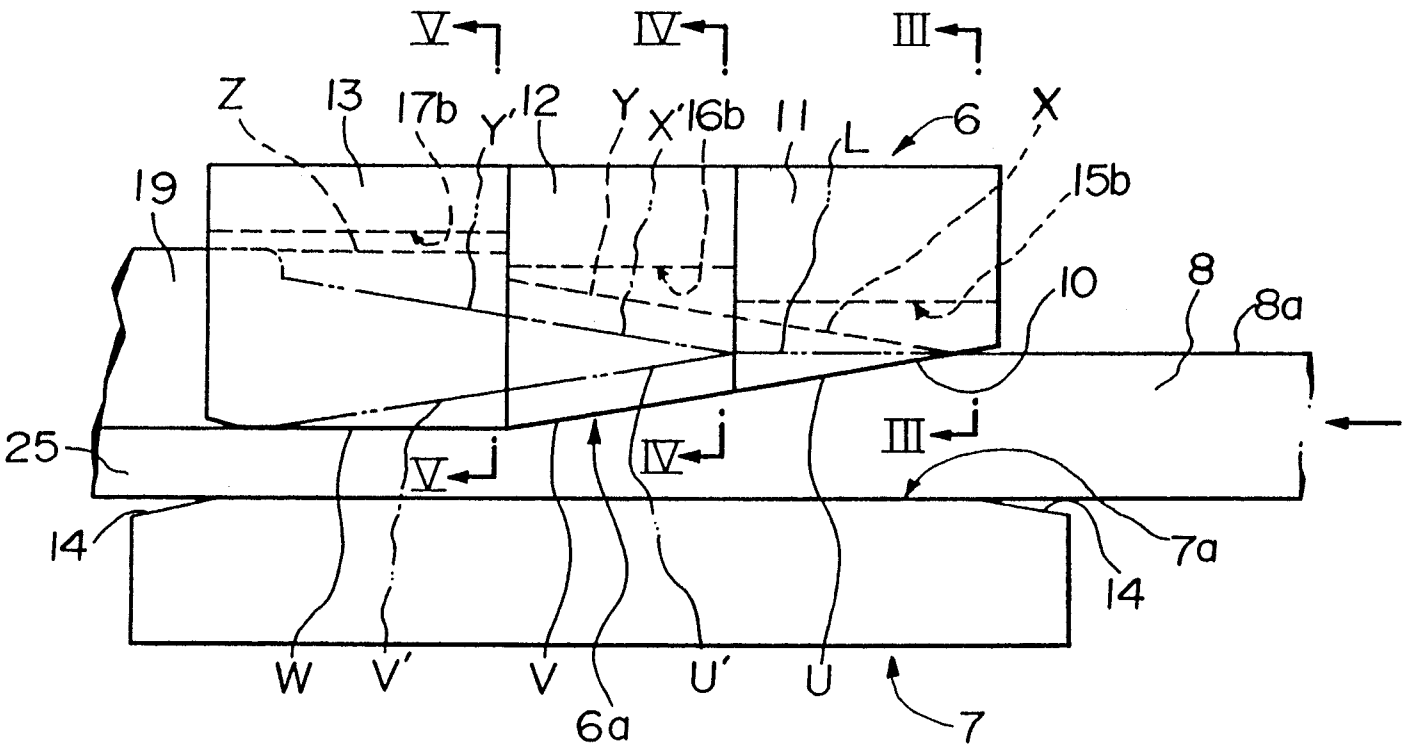
FIG. 2 is a side view of a pair of the dies of the press machine, showing a metal slab undergoing press working processing as in the press working apparatus of the first embodiment of the present invention.

The pressing surface 6*a* of the upper die 6 is inclined downwardly in the side view shown in FIG. 2, from the trailing end of the upper die 6 (that is, the front edge of the front die portion 11) toward the rear end of the middle die portion 12. The pressing surface 7*a* of the lower die 7 is planar, but chamfers 14 are formed at both a trailing end and a leading end of the pressing surface 7*a*.

Figure 6:
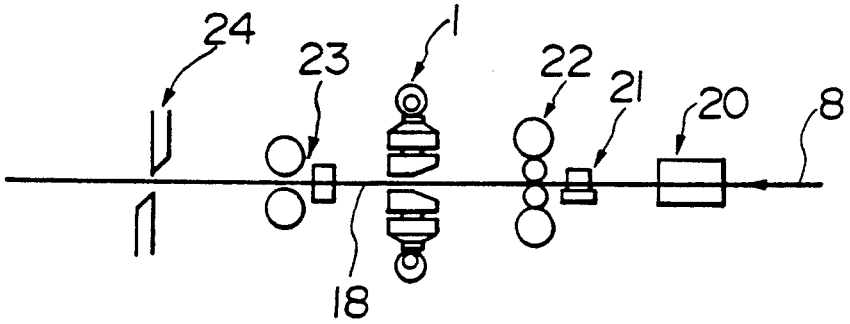
FIG. 6 is a schematic side view of the press working apparatus of the first embodiment of the present invention.
Figure 7:
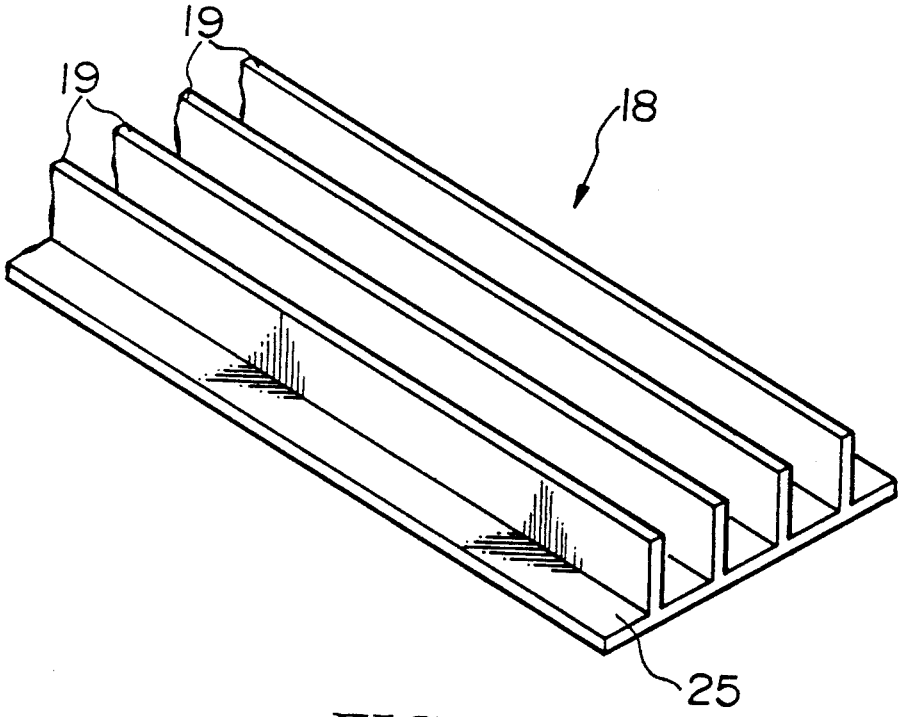
FIG. 7 is a partial isometric view of a ribbed board manufactured by the press working apparatus of the first embodiment of the present invention.

Furthermore, in this embodiment, as shown in FIG. 6, the press working apparatus is provided with a soaking pit 20 for maintaining the metal slab 8 in a predetermined heated state, an edge planer 21 for finishing side edges of the metal slab 8 so that the metal slab 8 has a predetermined width, and a rough finishing mill 22 for forming the metal slab 8 so as to have a predetermined thickness. The pit 20, the edge planer 21, and the rough finishing mill 22, are arranged along a slab transfer line, before the press machine 1 and in the order as described above. The arrangement order of the edge planer 21 and the rough finishing mill 22 may be reversed. The press working apparatus is also provided with a finishing mill 23 for finishing the thickness and the width of the formed article by the press machine 1 and for further forming the shape of the formed article, and with a shearing machine 24 for cutting the formed article so as to have a predetermined length. The finishing mill 23 and the shearing machine 24 are arranged along the slab transfer line, after the press machine 1, and in the order as described above.

According to the press working apparatus of the first embodiment, the metal slab 8 is maintained in a predetermined heated state by means of the soaking pit 20. In the next step, the metal slab 8 is finished to a predetermined thickness and width by means of the edge planer 21 and the rough finishing mill 22. The metal slab 8 is then formed into the ribbed board by the press machine 1. The formed article is finished to the predetermined thickness and width by the finishing mill 23, and the flatness of the formed article is also improved. The formed article finished by the finishing mill 23 is then cut by the shearing machine 24 into predetermined lengths.

The metal slab 8 is press formed by means of the pair of press dies 6 and 7 of the press machine 1. When this is done, the metal slab 8 is stepwise formed into approximately its final shape by means of the first grooves 15*b*, the second grooves 16*b*, and the third grooves 17*b* having cross-sectional shapes approximating the shapes of the final article to be produced. That is, at the first grooves 15*b*, as shown in FIG. 2, the portion of an upper face 8*a* of the metal slab 8, corresponding to the first ridges 15*a* of the first die portion 11, is pressed from the level shown by the double-dotted line L to the position shown by the solid line U, by the first ridges 15*a*. In contrast, the portion of the upper face part 8*a*, corresponding to the first grooves 15*b* of the first die portion 11, is moved into the first grooves 15*b* from the level L to the position shown by the broken line X, so that the portion slightly protrudes. In the next step, when the portion of the metal slab 8 corresponding to the first die portion 11 moves to the position which corresponds to the middle die portion 12, the pressed portion shown by the double-dotted line U', pressed by the first ridges 15*a* of the first die portion 11, is further pressed to the position shown by the solid line V. Thus, the protruding portion, shown by the double-dotted line X', which protrudes in the first grooves 15*b*, is further moved into the second grooves 16*b* as shown by the broken line Y. Then, when the portion of the metal slab 8 corresponding to the second die portion 12 moves to the position which corresponds to the rear die portion 13, the pressed portion shown by the double-dotted line V' pressed by the second ridges 16*a* of the second die portion 12 is further pressed to the position shown by the solid line W. Thus, the protruding portion, shown by the double-dotted line Y', which protrudes in the second grooves 16*b*, further protrudes into the third grooves 17*b*, as shown by the broken line Z. At this position, the metal slab 8 is formed approximately into the required shape since the sectional-shape of the third groove 17*b* is approximately the same as the final shape of the rib 19 of the final article to be produced, that is, the ribbed board 18.

As explained above, the final article 18 manufactured by the press working apparatus has such a shape that the ribs 19 are formed parallel to one another extending longitudinally on board portion 25 of a predetermined thickness. Because of this, it is possible to obtain the ribbed board 18 without welding, and therefore, the labor efficiency of making the article 18 is improved. Additionally, since it is possible to avoid welding defects and to obtain a forging (hammering) effect, it is also possible to improve the quality of the article.

Figure 8:
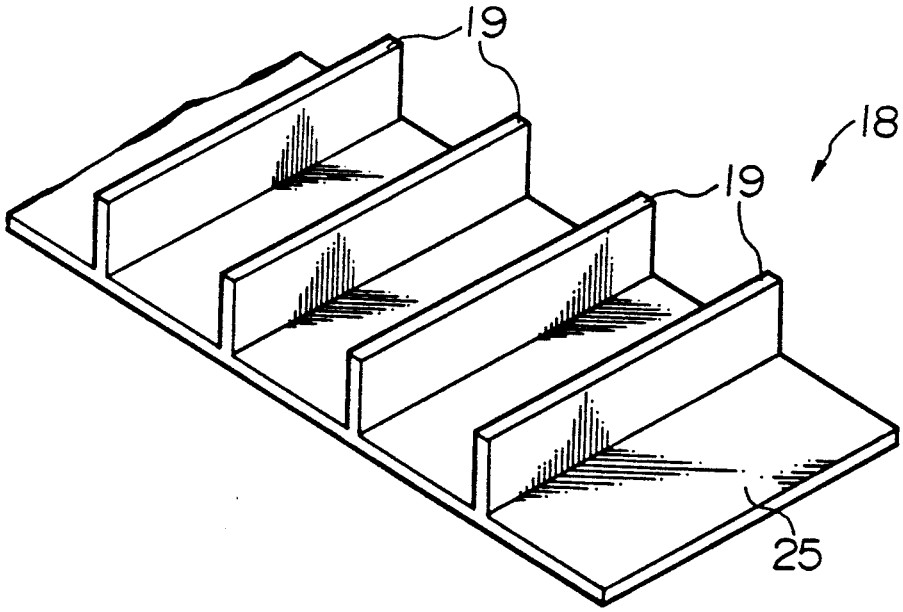
FIG. 8 is a partial isometric view of another ribbed board manufactured by use of the press working apparatus of the first embodiment of the present invention.

Additionally, according to the press working apparatus, it is possible, by a suitable number of divisions of the upper die 6 and a suitable formation of the shapes of the grooves, to form the ribs 19 in a direction transverse to the longitudinal direction of the board portion 25, as shown in FIG. 8.

Figure 9:
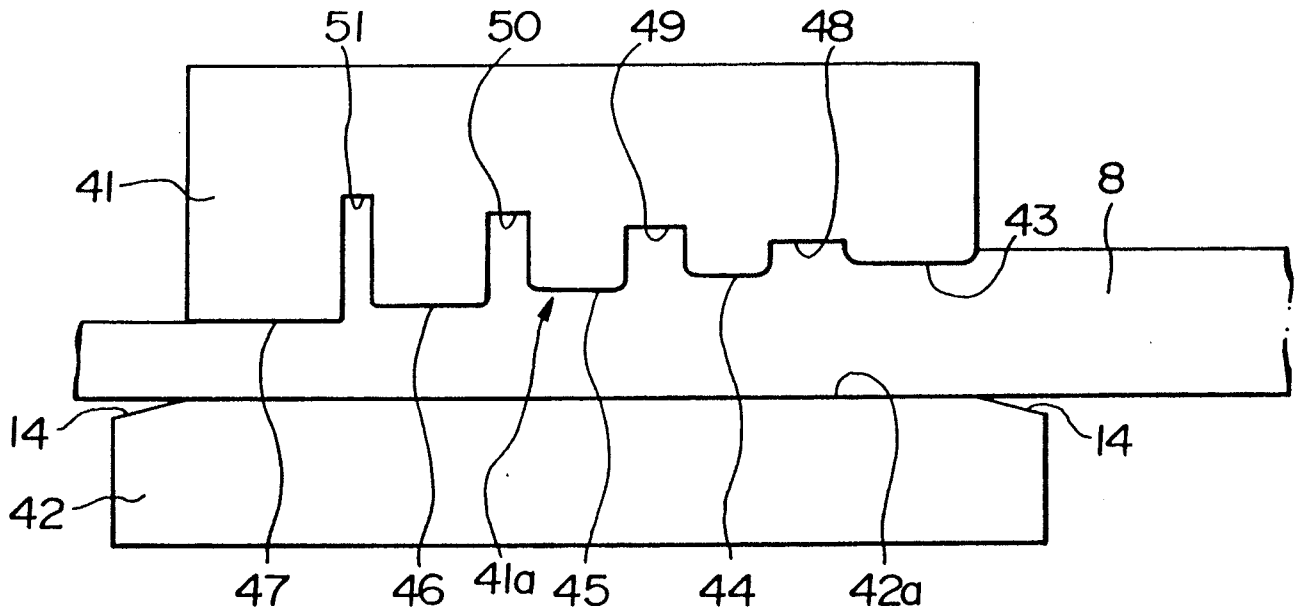
FIG. 9 is a side view of a pair of the dies of the press machine, showing a metal slab undergoing press working processing adopted to make the ribbed board shown in FIG. 8.

FIG. 9 shows a pair of press dies 41 and 42 of the press machine, having compositions differing from the press dies 6 and 7 above, for forming the ribbed board 18 shown in FIG. 8. In this case, a pressing surface 41*a* of the upper die 41 is divided by four slots 48–51 extending in the direction transverse to the feeding direction, into five pressing surfaces along the feeding direction: a first pressing surface 43, a second pressing surface 44, a third pressing surface 45, a fourth pressing surface 46, and a fifth pressing surface 47. The second pressing surface 44 protrudes downwardly below the first pressing surface 43; the third pressing surface 45 further protrudes downwardly below the second pressing surface 44; and the fourth pressing surface 46 further protrudes downwardly below the third pressing surface 45. The level of the fourth pressing surface 46 and the fifth pressing surface 47 are the same. The first slot 48, which is shallow and wide, is formed between the first pressing surface 43 and the second pressing surface 44; the second slot 49, which is narrower and deeper than the first slot 48, is formed between the second pressing surface 44 and the third pressing surface 45; the third slot 50, which is narrower and deeper than the second slot 49, is formed between the third pressing surface 45 and the fourth pressing surface 46; and the fourth slot 51, which is narrower and deeper than the fourth slot 50, is formed between the fourth pressing surface 46 and the fifth pressing surface 47. The pitches between these slots 48–51 are equal.

According to the press working apparatus which includes a press machine having the pair of dies 41 and 42, a ribbed board 18 as shown in FIG. 8 can be obtained by pressing the metal slab 8 with the dies 41 and 42 while the metal slab 8 is advanced one slot along the slots 48–51, due to a function similar to that explained above with respect to FIG. 2.

Figure 10:
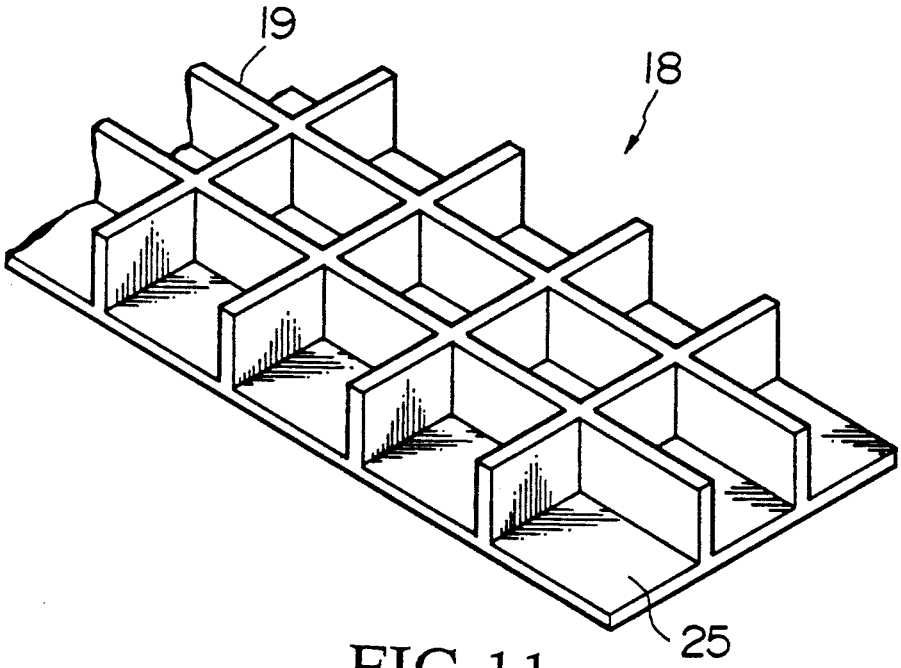
FIG. 10 is a partial isometric view of another ribbed board manufactured by use of the press working apparatus of the first embodiment of the present invention.
Figure 11:
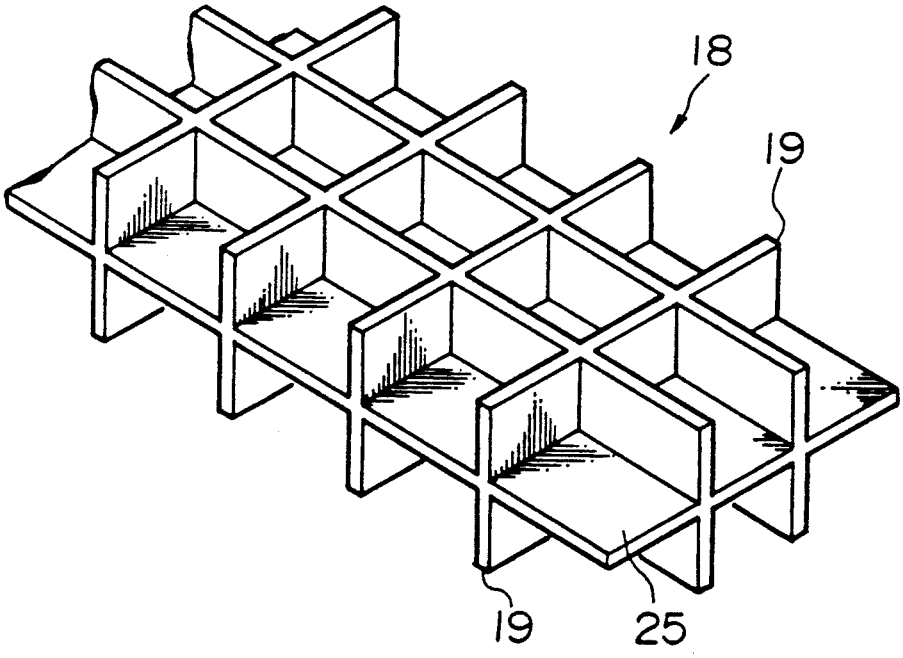
FIG. 11 is a partial isometric view of another ribbed board manufactured by use of the press working apparatus of the first embodiment of the present invention.
Figure 12:
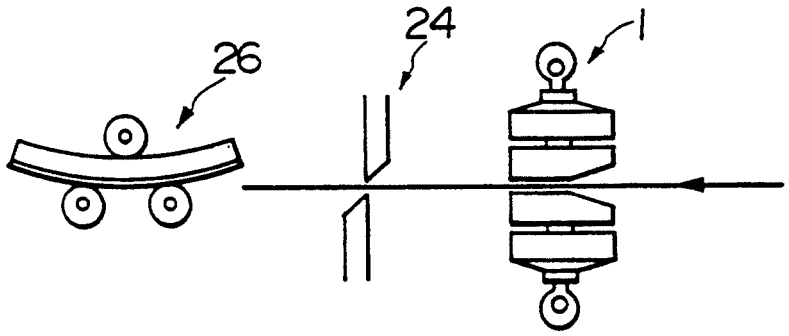
FIG. 12 is a partial schematic side view of the press working apparatus with a three roller bender.
Figure 13:
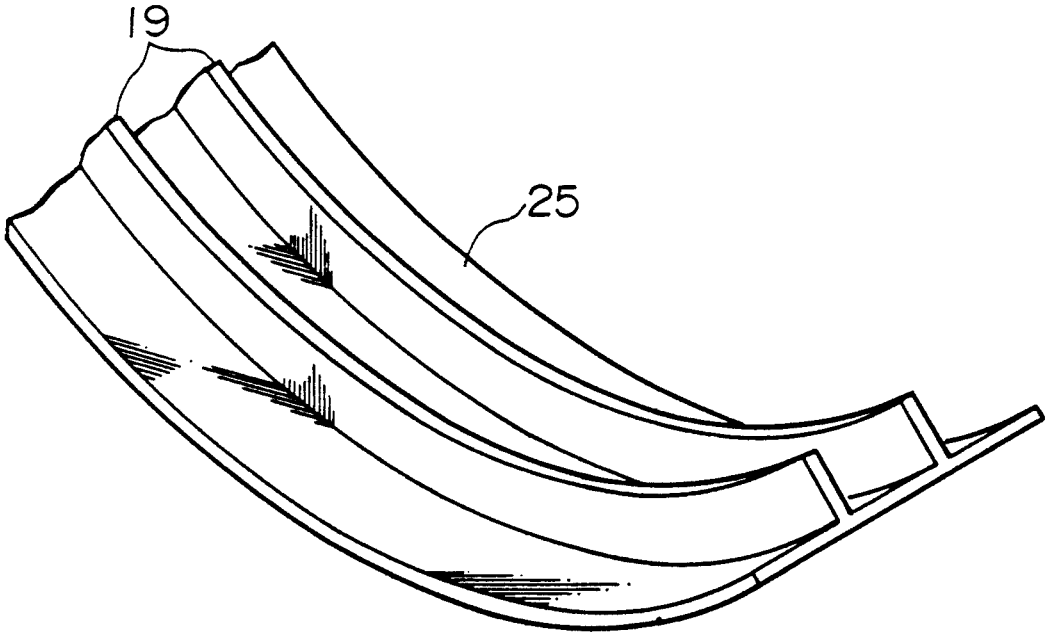
FIG. 13 is a partial isometric view of another ribbed board manufactured by use of the press working apparatus of the first embodiment of the present invention.
Figure 14:
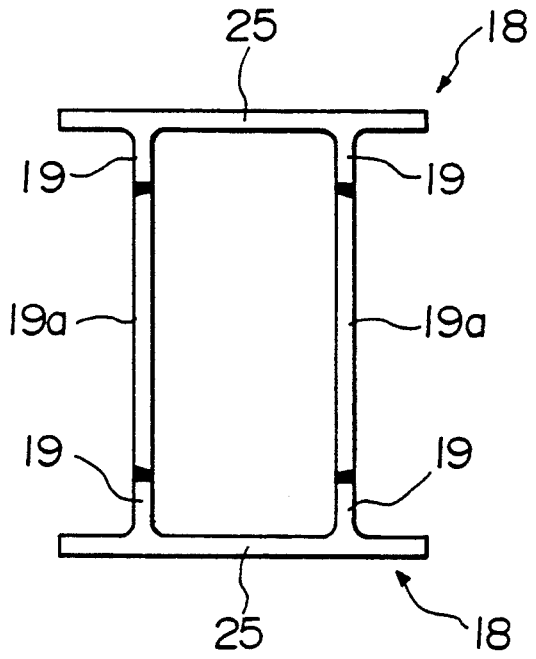
FIG. 14 is a front view of a member manufactured by use of a ribbed board made by the press working apparatus of the first embodiment of the present invention.
Figure 15:
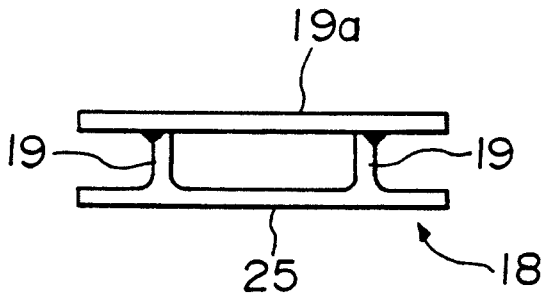
FIG. 15 is a front view of another member manufactured by use of a ribbed board made by the press working apparatus of the first embodiment of the present invention.

Furthermore, in a manner similar to the above, it is possible, by a suitable selection of the numbers of divisions of the upper die and a suitable selection of the forms of the ridges and grooves, to form a lattice structure rib 19 as shown in FIG. 10 or another type of rib (e.g., honey-comb construction) on the board portion 25. It is also possible, by forming ridges and grooves on the pressing surface 7*a* of the lower press die 7 as well as on the upper press die 6, to form the lattice structured ribs 19 on both sides of the board portion 25, as shown in FIG. 11. Additionally, it is possible to bend the formed article into a predetermined shape as shown in FIG. 13 by a three roller bender 26 (see FIG. 12), after the formed article is cut by the shearing machine 24. Moreover, it is possible to obtain a box-shaped member such as that shown in FIG. 14, by welding the ribs 19 of two of the mutually opposing ribbed boards 18 to steel sheets 19*a* placed between the opposed ribs 19. It is also possible to obtain another type of box-shaped member, such as that shown in FIG. 15, by welding a steel sheet 19*a* to the ends of the ribs 19 of the ribbed board 18.

Furthermore, in the press working apparatus of the first embodiment, it is possible to provide a coiling box for coiling the formed article, or a flattening machine for reforming the formed article formed by the press machine, instead of, or together with, the finishing mill 23.

Next, with reference to FIGS. 16–25, the press working apparatus of the second embodiment of the present invention will be explained.

The press working apparatus of the second embodiment differs from the press machine of the first embodiment above in that the composition of the press dies are altered; therefore, only the modifications thereof will be explained below.

Figure 16:
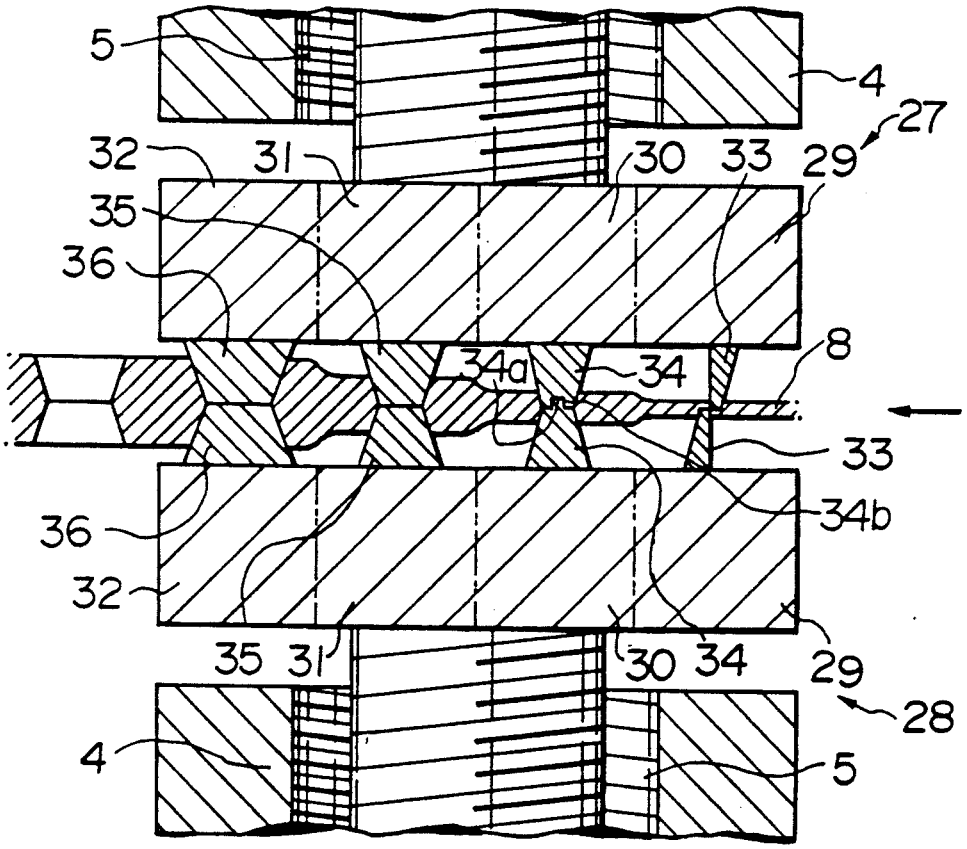
FIG. 16 is a sectional side view of a pair of the dies of the press machine, showing a metal slab in press working processing adopted in the second embodiment of the present invention.

As shown in FIG. 16, an upper press die 27 and an lower press die 28 are paired, and both of the press dies are divided in a plurality (four, in this embodiment) of die portions 29–32 along the feeding direction. Each of the first die portions 29 is positioned at a trailing side of each of the dies 27 and 28. At each of the first die portions 29 of both dies 27 and 28, a plurality of first protrusions 33, formed approximately in a trapezoidal shape in cross section, are arranged in the direction transverse to the feeding direction at predetermined pitches. At each of the second die portions 30 positioned at the back of each of the first die portions 29 in the feeding direction, the same number of second protrusions 34, formed approximately in a trapezoidal shape in cross section, but having a sectional area which is larger than that of the first protrusions 33, is arranged in the direction transverse to the feeding direction at the same pitch as the first protrusions 33. At each of the third die portions 31 positioned at the back of each of the second die portions 30 in the feeding direction, the same number of third protrusions 35, formed approximately in a trapezoidal shape in cross section, but having a sectional area which is larger than that of the second protrusions 34, is arranged in the direction transverse to the feeding direction at the same pitches as the first protrusions 33. Furthermore, at each of the fourth die portions 32 positioned at the exit side in the feeding direction, the same number of fourth protrusions 36, formed approximately in a trapezoidal shape in cross section, but having a sectional area which is larger than that of the third protrusions 35, is arranged in the transverse direction to the feeding direction at the same pitches as the first protrusions 33. All the protrusions 33–36 of both of the dies 27 and 28 are approximately opposing each other, and pitches between these arrangements of the protrusions 33–36 are the same.

The diameters (or the sizes of sides) of the end surfaces of the protrusions 35 are defined such that the diameters are less than those of the holes to be opened by the second protrusions 34. The diameters (or the sizes of sides) of the end surfaces of the fourth protrusions 36 are defined such that the diameters are less than those of the holes to be opened by the third protrusions 35. Additionally, recesses **34*a* are formed at the end surfaces of the second protrusions 34 of the upper die 27 as shown in FIG. 16, and tips 34*b* which can enter into the recesses 34*a* are formed at the end surface of the second protrusions 34 of the lower die 28**.

Figure 17:
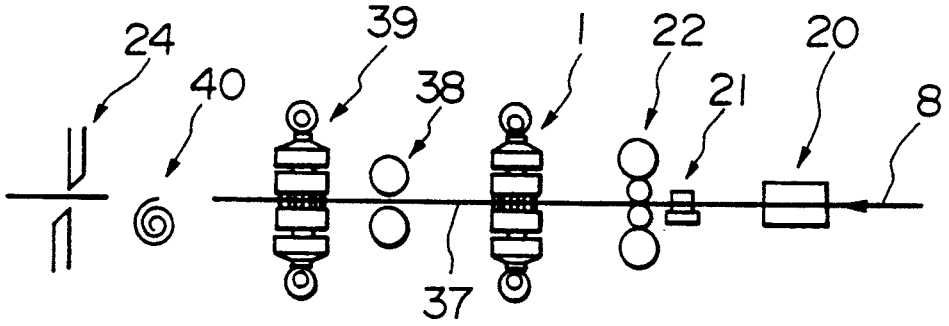
FIG. 17 is schematic side view of the press working apparatus of the second embodiment of the present invention.

Furthermore, in this embodiment, as shown in FIG. 17, the press working apparatus is provided with a soaking pit 20 for maintaining the metal slab 8 in a predetermined heated state, an edge planer 21 for finishing side edges of the metal slab 8 so that the metal slab 8 is of a predetermined width, and a rough finishing mill 22 for roughly finishing the metal slab 8 so as to have a predetermined thickness. These machines, that is, the soaking pit 20, the edge planer 21, and the rough finishing mill 22, are arranged before the press machine 1 in the slab transfer line, in the order described above. The order of the arrangement of edge planer 21 and the rough finishing mill 22 may be reversed. The press working apparatus relating to the second embodiment is also provided with an intermediate milling machine 38 for extending the formed article formed by the press machine 1, a finishing press machine 39 for finishing the shape of the formed article extended by the intermediate milling machine 38, and a coiler 40 for coiling the formed article finished by the finishing press machine 39 or a shearing machine 24 for cutting the formed article to predetermined lengths. These machines, that is, the intermediate milling machine 38, the finishing press machine 39, and the coiler 40 or the shearing machine 24, are arranged after the press machine 1 in the slab transfer line, in the order described above.

Figure 18:
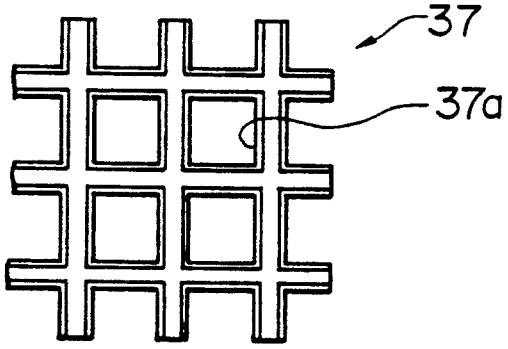
FIG. 18 is a plane view of a mesh grid manufactured by the press working apparatus of the second embodiment of the present invention, showing the state of the mesh grid after passing through press machine.
Figure 19:
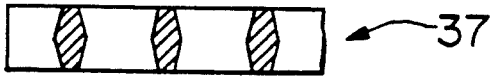
FIG. 19 is a sectional side view of the mesh grid shown in FIG. 18.
Figure 20:
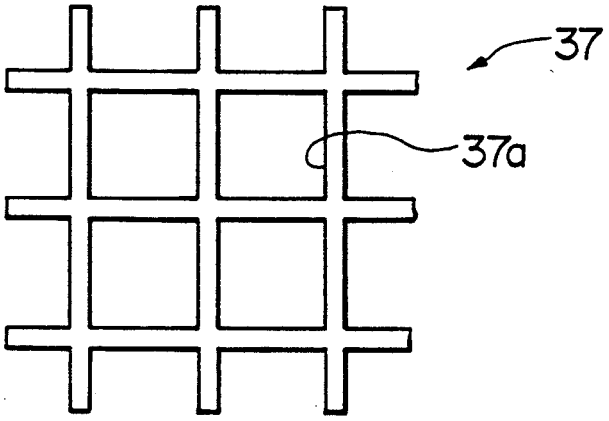
FIG. 20 is a plane view of a mesh grid manufactured by the press working apparatus of the second embodiment of the present invention, showing the state of the mesh grid after passing through the intermediate milling machine.
Figure 21:
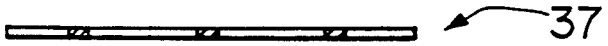
FIG. 21 is a sectional side view of the mesh grid shown in FIG. 20.
Figure 22:
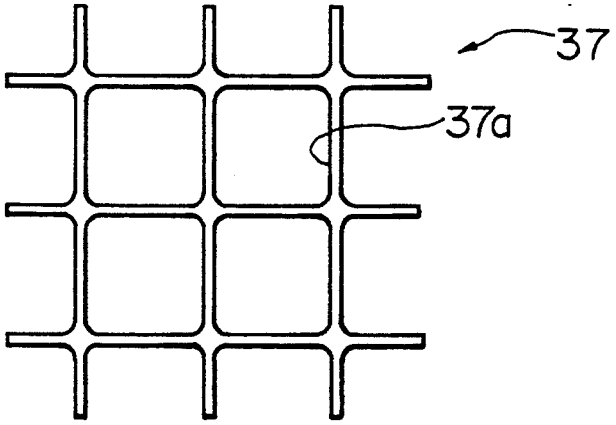
FIG. 22 is a plane view of a mesh grid manufactured by the press working apparatus of the second embodiment of the present invention, showing the state of the mesh grid after passing through the finishing press machine.
Figure 23:
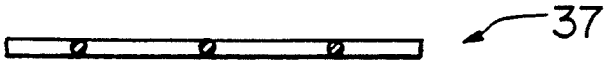
FIG. 23 is a sectional side view of the mesh grid shown in FIG. 22.

In accordance with a press working apparatus composed as above, the metal slab 8 is maintained in a predetermined heated state by means of the soaking pit 20. In the next stage, the metal slab 8 is finished to a predetermined thickness and width by means of the edge planer 21 and the rough finishing mill 22. Then, the metal slab 8 is formed into a mesh grid by the press machine 1, as shown in FIGS. 18 and 19. Following this, the formed article is extended by the intermediate milling machine 38 as shown in FIGS. 20 and 21; the formed article is then finished into a form, such as that shown in FIGS. 22 and 23, by the finishing press machine 39. After this, the finished article is coiled by the coiler 40, or cut by the shearing machine 24 to predetermined lengths.

When this operation is performed, first, the metal slab 8 is punched by the first protrusions 33 of the first die portion 29 of the pair of press dies 27 and 28. Then, the punched holes of the metal slab 8 are extended stepwise by the second protrusions 34, the third protrusions 35, and the fourth protrusions 36, in that order, as the metal slab 8 is transferred at each pitch of the protrusions. Thus, the metal slab 8 is gradually formed into a shape similar to that of the finished article to be produced, such that the metal slab 8 has a predetermined thickness and has holes **37*a* of predetermined size. When this is done, if the metal slab 8 is not punched sufficiently by the first protrusions 33 which should first punch the metal slab 8, the holes may be formed on the metal slab 8 by the second protrusions 34 since the second protrusions 34 have the recesses 34*a* and the tips 34*b***. The form of the formed article in cross section may be a circle, an oval, a rectangle, or the like.

Figure 24:
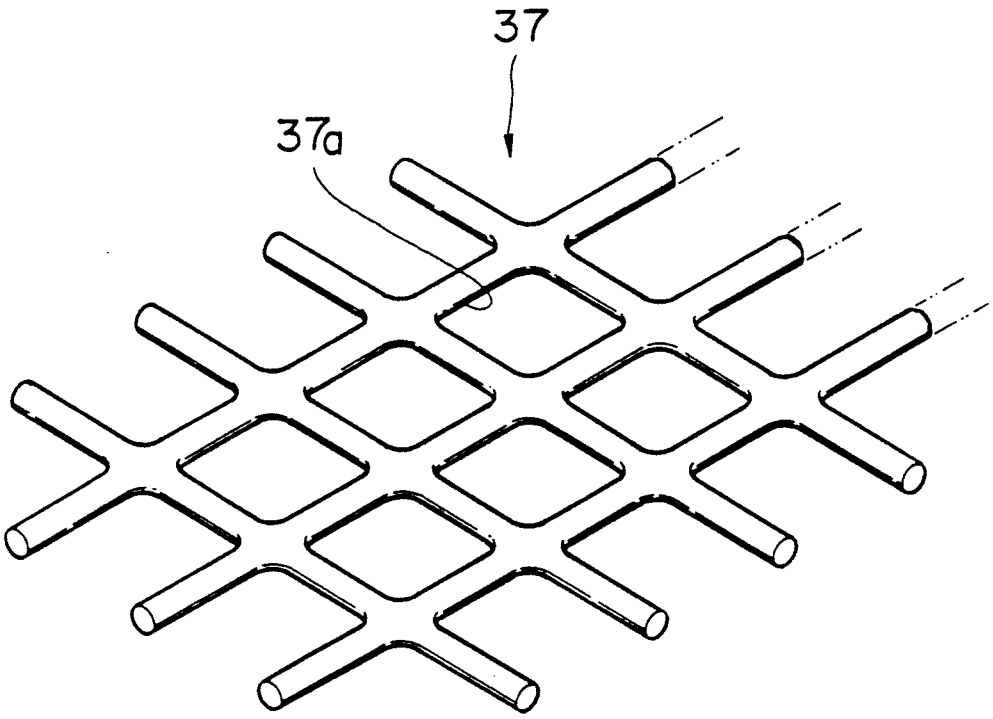
FIG. 24 is a partial isometric view of the mesh grid shown in FIG. 22 and FIG. 23.

The press formed article 37 formed by the press machine 1 is ultimately formed into a net structure as shown in FIG. 24. Therefore, according to the press working apparatus of the second embodiment of the present invention, a mesh grid such as a reinforcing net can be manufactured without complicating work such as welding or the tying of numerous steel bars. Additionally, it is possible to omit the intermediate milling machine 38 if the size of the holes **37*a*** to be formed is small.

Figure 25:
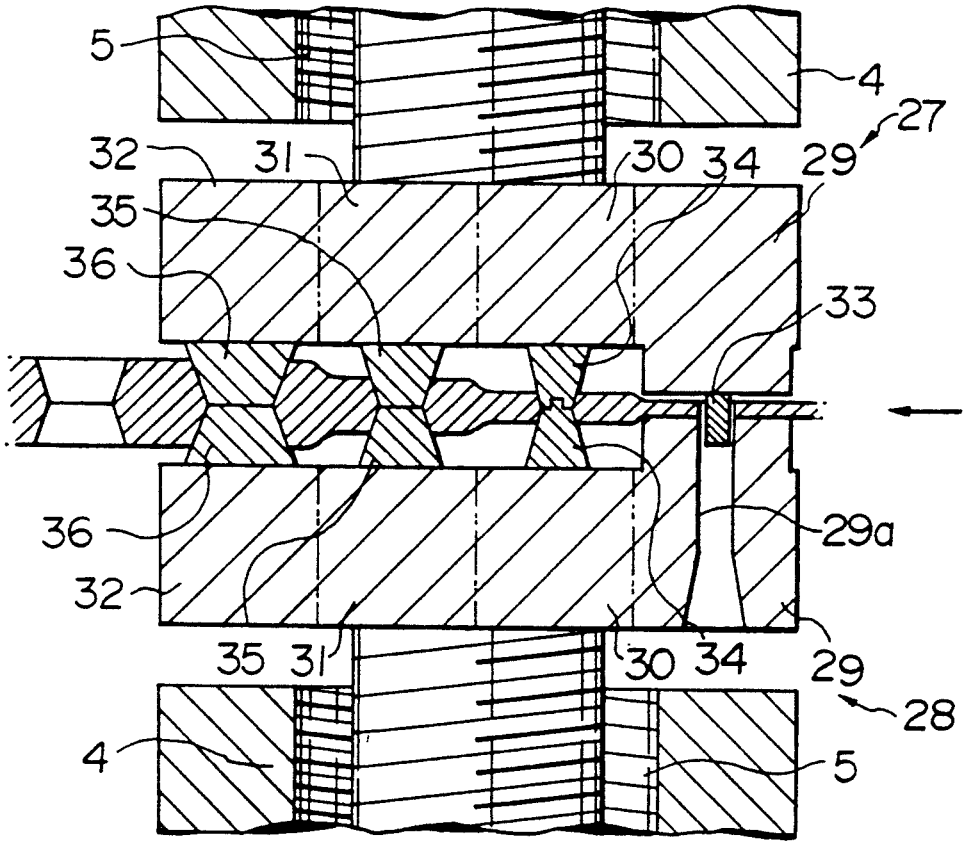
FIG. 25 is a sectional side view of another type of a pair of the dies of the press machine, showing the metal slab in press working processing adopted in the second embodiment of the present invention.

FIG. 25 shows another composition of the press machine which is adopted in the press working apparatus of the second embodiment above. The composition of the press machine is similar to that of the press machine shown in FIG. 16; therefore, explanation of corresponding members bearing the same numerals as those shown in FIG. 16 will be omitted.

First die portions 29 of the upper press die 27 and lower press die 28 of this press machine are, on the whole, adjacent to each other compared to other die portions 30–32. At the first die portion 29 of the upper press die 27, first protrusions 33 are formed in a manner similar to those in the press machine shown in FIG. 16. In contrast, at the first die portion 29 of the lower press die 28, holes 29*a*, into which the first protrusions 33 can be inserted, are formed at the position corresponding to the first protrusions 33 of the upper press die 27. These holes 29*a* pass through the lower press die 28 from an upper surface to a lower surface thereof and allow the punched metal to escape. Other features of the press machine are the same as those shown in FIG. 19.

In accordance with the press machine above, the metal slab 8 is punched through by the first protrusions 33 of the upper press die 27; thus, through holes are formed in the metal slab 8 at the first die portions 29 of the press dies 27 and 28. In this case, the punched out metal of the metal slab 8, punched by the first protrusions 33, are removed from the lower press die 28 through the holes 29*a*. This press machine above is particularly optimal when the press machine is used for a metal slab 8 having a small thickness.

In the case in which the apparatuses relating to the first embodiment and the second embodiment of the present invention are combined, it is possible to manufacture a required article using only a single manufacturing line merely by the changing the pair of press dies 6 and 7, 41 and 42, and 27 and 28. Furthermore, this invention may be applied to a metal slab made of nonferrous metal. Moreover, a continuous casting furnace may be used instead of the soaking pit 20. It is also possible to adopt either a start-stop control system or a continuous control system.

What is claimed is:

1. A press working apparatus comprising:

a press machine having a pair of press dies for pressing a preheated metal slab having a thickness and being transferred in a feeding direction perpendicular to the thickness;

said press dies being mutually opposing and arranged to press said metal slab in a direction parallel to the thickness of said metal slab;

each said press die having a pressing surface facing a respective surface of said metal slab;

said pressing surface of each said die having a predetermined length extending in said feeding direction of said metal slab;

at least one said pressing surface having a cross section perpendicular to said feeding direction of said metal slab, a shape f said cross section gradually changing along the feeding direction of said metal slab so as to have a predetermined sectional shape for forming said metal slab into a required sectional shape at a leading end of the pressing surfaces in the feeding direction; and at least one said pressing surface having at least one groove extending in the feeding direction, a depth of the at least one groove gradually increasing in the feeding direction, and a width of the at least one groove gradually decreasing in the feeding direction.

2. A press working apparatus according to claim 1, wherein said shape in cross section of at least one of said pressing surfaces changes stepwise in said feeding direction.

3. A press working apparatus according to claim 1, wherein said shape in cross section of both pressing surfaces gradually change in said feeding direction.

4. A press working apparatus according to claim 1, further comprising a plurality of grooves parallel to said at least one groove, each of the grooves having a width and a depth, the depth gradually increasing in the feeding direction and the width gradually decreasing in the feeding direction.

5. A press working apparatus according to claim 2, further comprising a plurality of parallel slots extending transversely to the feeding direction on at least one of pressing surfaces, each of said slots having a width and a depth, the width decreasing in the feeding direction, the depth increasing in the feeding direction, and wherein at least one of the pressing surfaces is designed such that distance between the pressing surfaces decreases in the feeding direction.

6. A press working apparatus according to claim 3, wherein the shapes in cross section of both said pressing surfaces change stepwise in the feeding direction.

7. A press working apparatus comprising:

a press machine having a pair of press dies for pressing a preheated metal slab having a thickness and being transferred in a feeding direction perpendicular to the thickness;

said press dies being mutually opposing and arranged to press said metal slab in a direction parallel to the thickness of said metal slab;

each said press die having a pressing surface facing a respective surface of said metal slab;

said pressing surface of each said die having a predetermined length extending in said feeding direction of said metal slab;

said pressing surface of each said die having a cross section perpendicular to said feeding direction of said metal slab, a shape of each said cross section changing stepwise along the feeding direction of said metal slab so as to have a predetermined sectional shape for forming said metal slab into a required sectional shape at a leading end of the pressing surface of each said die in the feeding direction; and a plurality of protrusions of punching said metal slab formed on said pressing surface of each said die, said protrusions being arranged in both the feeding direction and a direction transverse to the feeding direction in columns and rows of predetermined pitches, and diameters of said protrusions increasing in said rows in the feeding direction.

8. A press working apparatus according to claim 7, wherein:

said protrusions on a first of said pressing surfaces are arranged in columns in the feeding direction and arranged in rows in the direction transverse to the feeding direction;

said columns and rows of protrusions on said first of said pressing surfaces being disposed at predetermined pitches;

said protrusions on a second of said pressing surfaces generally being in positions corresponding to the protrusions on said first of said pressing surfaces except in the row at a trailing end of said first pressing die in the feeding direction;

said second of said pressing surfaces having holes formed at positions corresponding to protrusions in the row at the trailing end of said first pressing die in the feeding direction; and diameters of said protrusions on said pressing surfaces increasing in the feeding direction.

9. A press working apparatus according to one of claims 1, 2, 4, and 5, further comprising a soaking pit for maintaining said metal slab in a predetermined heated state, an edge planer for finishing said metal slab to a predetermined width, and a rough finishing mill for finishing said metal slab to a predetermined thickness positioned before said press machine;

a finishing mill for finishing a width, thickness, and a bend of a formed article formed by said press machine positioned after said press machine; and a shearing machine for cutting the formed article to predetermined lengths positioned after said press machine.

10. A press working apparatus according to one of claims 3 and 6, further comprising a soaking pit for maintaining said metal slab in a predetermined heated state, an edge planer for finishing said metal slab to a predetermined width, and a rough finishing mill for finishing said metal slab to a predetermined thickness positioned before said press machine;

an intermediate milling machine for finishing a formed article formed by said press machine positioned after said press machine; and a coiler for coiling the formed article finished by said intermediate milling machine or a shearing machine for cutting the formed article into a predetermined length positioned after said press machine.

11. A press working apparatus comprising:

a press machine having a pair of press dies for pressing a preheated metal slab having a thickness and being transferred in a feeding direction perpendicular to the thickness;

said press dies being mutually opposing and arranged to press said metal slab in a direction parallel to the thickness of said metal slab;

each said press die having a pressing surface facing a respective surface of said metal slab;

said pressing surface of each said die having a predetermined length extending in said feeding direction of said metal slab;

at least one said pressing surface having a cross section perpendicular to said feeding direction of said metal slab, a shape of said cross section changing stepwise along the feeding direction of said metal slab so as to have a predetermined sectional shape for forming said metal slab into a required sectional shape at a leading end of the pressing surfaces in the feeding direction; and at least one said pressing surfaces having a plurality of parallel slots extending transversely to the feeding direction, each of said slots having a width and a depth, the width decreasing in the feeding direction, the depth increasing in the feeding direction, and wherein at least one of the pressing surfaces is designed such that distance between the pressing surfaces decreases in the feeding direction.

12. A press working apparatus according to one of claims 7 and 8, further comprising a soaking pit for maintaining said metal slab in a predetermined heated state, an edge planer for finishing said metal slab to a predetermined width, and a rough finishing mill for finishing said metal slab to a predetermined thickness positioned before said press machine;

an intermediate milling machine for finishing a formed article formed by said press machine positioned after said press machine; and a coiler for coiling the formed article finished by said intermediate milling machine or a shearing machine for cutting the formed article into a predetermined length positioned after said press machine.

13. A press working apparatus according to claim 11, further comprising a soaking pit for maintaining said metal slab in a predetermined heated state, an edge planner for finishing said metal slab to a predetermined width, and a rough finishing mill for finishing said metal slab to a predetermined thickness positioned before said press machine;

a finishing mill for finishing a width, thickness, and a bend of a formed article formed by said press machine positioned after said press machine; and a shearing machine for cutting the formed article to predetermined lengths positioned after said press machine.

* * * * *

UNITED STATES PATENT AND TRADEMARK OFFICE

CERTIFICATE OF CORRECTION

PATENT NO. : 5,327,767

DATED : July 12, 1994

INVENTOR(S) : Shigeki NARISHIMA

It is certified that error appears in the above-indentified patent and that said Letters Patent is hereby corrected as shown below:

Claim 1, Column 9, Line 55 "f" should read --of--.

Signed and Sealed this

Twenty-seventh Day of December, 1994

*Attest:*

Bruce Lehman

BRUCE LEHMAN

*Attesting Officer*

*Commissioner of Patents and Trademarks*